US009650856B2

(12) United States Patent
Gaude et al.

(10) Patent No.: US 9,650,856 B2
(45) Date of Patent: May 16, 2017

(54) ASSEMBLY AND SYSTEM INCLUDING A SURGE RELIEF VALVE

(71) Applicants: Cameron International Corporation, Houston, TX (US); Shell Oil Company, Houston, TX (US)

(72) Inventors: Edward C. Gaude, Houston, TX (US); Brian Matteucci, Houston, TX (US); Johannes Van Wijk, GS Rijswijk (NL)

(73) Assignee: Cameron International Corporation, Houston, TX (US)

( * ) Notice: Subject to any disclaimer, the term of this patent is extended or adjusted under 35 U.S.C. 154(b) by 586 days.

(21) Appl. No.: 14/078,157

(22) Filed: Nov. 12, 2013

(65) Prior Publication Data

US 2015/0129233 A1 May 14, 2015

(51) Int. Cl.
*E21B 33/064* (2006.01)
*E21B 34/04* (2006.01)
*E21B 33/035* (2006.01)

(52) U.S. Cl.
CPC ..... *E21B 33/064* (2013.01); *E21B 33/0355* (2013.01); *E21B 34/04* (2013.01)

(58) Field of Classification Search
CPC ..... E21B 33/0355; E21B 33/064; E21B 34/04
See application file for complete search history.

(56) References Cited

U.S. PATENT DOCUMENTS 3,338,302 A * 8/1967 Hubby ..... E21B 33/0355 166/351
3,993,100 A * 11/1976 Pollard ..... E21B 33/035 137/628
4,132,153 A 1/1979 Grotness et al.
4,923,008 A * 5/1990 Wachowicz ..... E21B 29/08 137/14
4,955,195 A * 9/1990 Jones ..... E21B 34/16 137/1
5,398,761 A 3/1995 Reynolds
6,192,680 B1 * 2/2001 Brugman ..... E21B 33/0355 60/398

(Continued)

FOREIGN PATENT DOCUMENTS

JP 2011231616 A 11/2011

OTHER PUBLICATIONS

Acceleration Valve, Model 6679 and Deceleration Valve, Model 6680; Published by PHD, Inc., Fort Wayne, Ind. as early as Jan. 2, 1979; References U.S. Pat. No. 4,132,153.

(Continued)

*Primary Examiner* — Matthew R Buck
(74) *Attorney, Agent, or Firm* — Chamberlain Hrdlicka

(57) ABSTRACT

A fluid control system may be included within a blowout preventer subsea control pod of a subsea drilling system. The fluid control system includes a primary fluid flow path including an inlet and an outlet, the inlet connectable to a fluid supply source, the outlet connectable to a component controllable by the fluid supply source, a surge relief valve connected within the primary fluid flow path between the inlet and the outlet, and a control valve connected within the primary fluid flow path between the surge relief valve and the outlet such that hydraulic pressure surges received within the primary fluid flow path are dampened, at least partially, by the surge relief valve before received by the control valve.

19 Claims, 8 Drawing Sheets

(56) References Cited

U.S. PATENT DOCUMENTS

| | | | | |
|---|---|---|---|---|
| 7,757,772 | B2 * | 7/2010 | Donohue | E21B 33/0355 166/338 |
| 8,156,953 | B2 * | 4/2012 | Tveita | G05D 16/2033 137/102 |
| 8,240,199 | B2 * | 8/2012 | McMiles | E21B 47/10 73/152.53 |
| 9,234,400 | B2 * | 1/2016 | Warnock, Jr. | E21B 33/0355 |
| 2002/0100501 | A1 | 8/2002 | Hollister et al. | |
| 2004/0261858 | A1 | 12/2004 | Ferrel | |
| 2008/0271896 | A1 * | 11/2008 | Inderberg | E21B 17/07 166/355 |
| 2009/0095464 | A1 * | 4/2009 | McGrath | E21B 33/06 166/53 |
| 2011/0114329 | A1 * | 5/2011 | Emecheta | E21B 33/0355 166/350 |
| 2011/0284236 | A1 | 11/2011 | Baugh | |
| 2014/0131049 | A1 * | 5/2014 | Bourgeau | E21B 33/0355 166/363 |

OTHER PUBLICATIONS

International Search Report and Written Opinion issued in corresponding application No. PCT/US2014/065065 dated Feb. 25, 2015, 15 pgs.

* cited by examiner

ASSEMBLY AND SYSTEM INCLUDING A SURGE RELIEF VALVE

BACKGROUND

Blowout preventers, referred to in the oil and gas industry as BOPs, are used to prevent blowouts during the drilling and production of oil and gas wells. BOPs are installed at the wellhead for the purpose of reducing the likelihood of an undesired escape of fluid from an annular space between the casing and drill pipe or from an open hole during drilling and completion operations. On floating offshore rigs, such as semisubmersibles and drill ships, BOPs may be attached to the well on the seafloor.

BOPs are large, high-pressure valves capable of being remotely controlled. There are two basic types of BOPs, an annular-type BOP and a ram-type BOP. Typically, a plurality of BOPs are stacked on top of one another and referred to as a BOP stack. The BOP stack is attached to the wellhead.

Next to the BOPs is the well control system that monitors and controls the behavior of the subsea BOPs from the drilling rig. One of the components of the system that monitors and controls the behavior of the subsea BOPs is a subsea control pod. The subsea control pod is adapted to mount to the subsea BOP stack and provide a means of actuating and controlling the subsea BOP stack from the drilling vessel. Hydraulic lines from the drilling rig enter the subsea control pod, and the fluid is directed to the BOPs. The subsea control pod contains pilot operated control valves and pilot operated regulators which direct hydraulic fluids to the various BOP hydraulic operators controlling the BOP functions.

As such, when activating a BOP using a subsea control pod, pressurized hydraulic fluid is provided to the BOP through the valves and passages of the subsea control pod. Due to the high pressures of the hydraulic fluid, a pressure surge or wave caused from suddenly starting or stopping fluid flow, commonly referred to as fluid hammer or hydraulic shock, may reduce the life expectancy of the valves, hoses, and/or other components of the subsea control pod. Accordingly, it remains a priority to reduce the effects of a fluid hammer, for example, to increase the life expectancy of the components of a subsea control pod, particularly in these remote locations where maintenance may be difficult.

BRIEF DESCRIPTION OF THE DRAWINGS

For a detailed description of the preferred embodiments of the invention, reference will now be made to the accompanying drawings in which.

DETAILED DESCRIPTION

Figure 1:
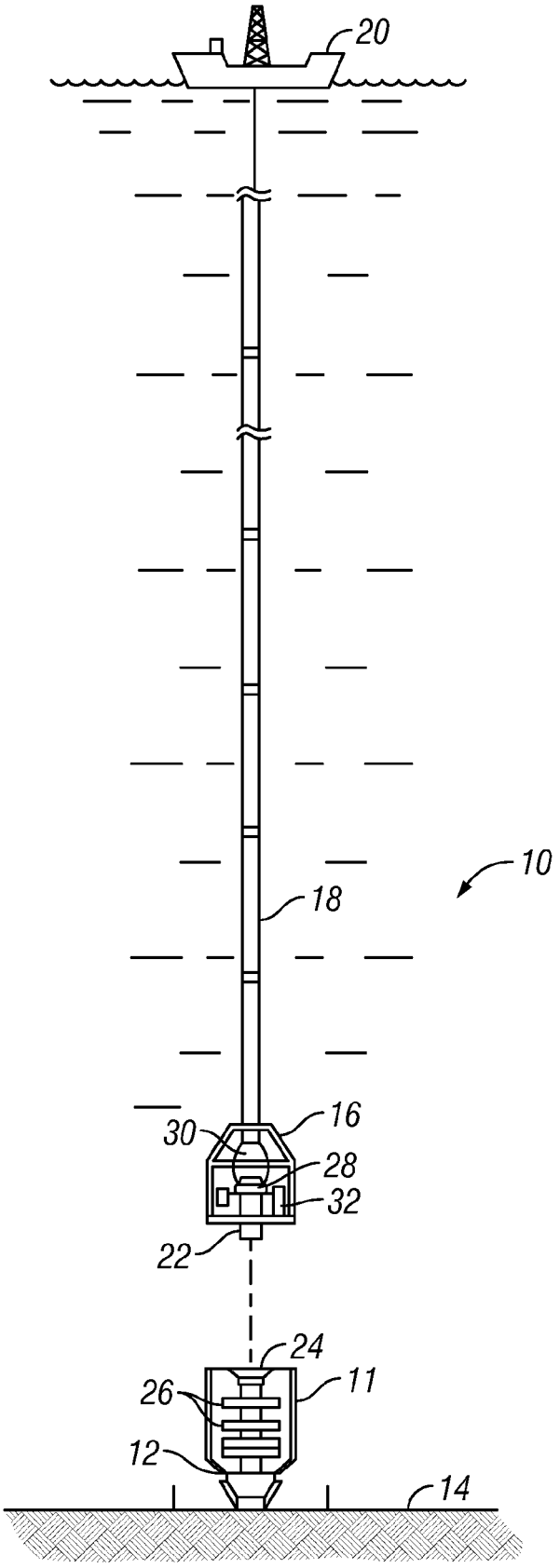
FIG. 1 shows a schematic view of a subsea drilling system in accordance with one or more embodiments of the present disclosure.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Referring now to FIG. 1, a schematic view of a subsea drilling system 10 in accordance with one or more embodiments of the present disclosure is shown. As an example, the subsea drilling system may include a lower blowout preventer stack ("lower BOP stack") 11 that may be rigidly attached to a wellhead 12 upon the sea floor 14. A Lower Marine Riser Package ("LMRP") 16 may be retrievably disposed upon a distal end of a marine riser 18, extending from a drill ship 20 or any other type of surface drilling platform or vessel. As such, the LMRP 16 may include a stinger 22 at a distal end thereof that may be configured to engage a receptacle 24 located on a proximal end of the lower BOP stack 11.

In one or more embodiments, the lower BOP stack 11 may be rigidly affixed atop the subsea wellhead 12 and may include (among other devices) a plurality of ram-type blowout preventers 26 useful in controlling the well during drilling and completion. The flexible riser 18 may provide a conduit through which drilling tools and fluids may be deployed to and retrieved from the subsea wellbore. The LMRP 16 may include (among other things) one or more ram-type blowout preventers 28 at a distal end thereof, an annular-type blowout preventer 30 at an upper end thereof, and one or more subsea control pods 32. For example, two subsea control pods 32 may be included within the LMRP 16, which may be referred to as a blue pod and a yellow pod, such that redundancy may be provided for the subsea control pod 32.

When desired or necessary, the ram-type blowout preventers of the LMRP 16 and the lower BOP stack 11 may be closed and the LMRP 16 may be detached from the lower BOP stack 11 and retrieved to the surface, leaving the lower BOP stack 11 atop the wellhead 12. Thus, for example, it may be necessary to retrieve the LMRP 16 from the lower BOP stack 11 and the wellhead 12, such as in times of inclement weather or when work is otherwise to be temporarily stopped. Also, when a part of the LMRP 16 fails, the entire LMRP 16 may need to be raised on the ship 20 for repairs and/or maintenance. One such part that may require maintenance is the subsea control pod 32.

Figure 2:
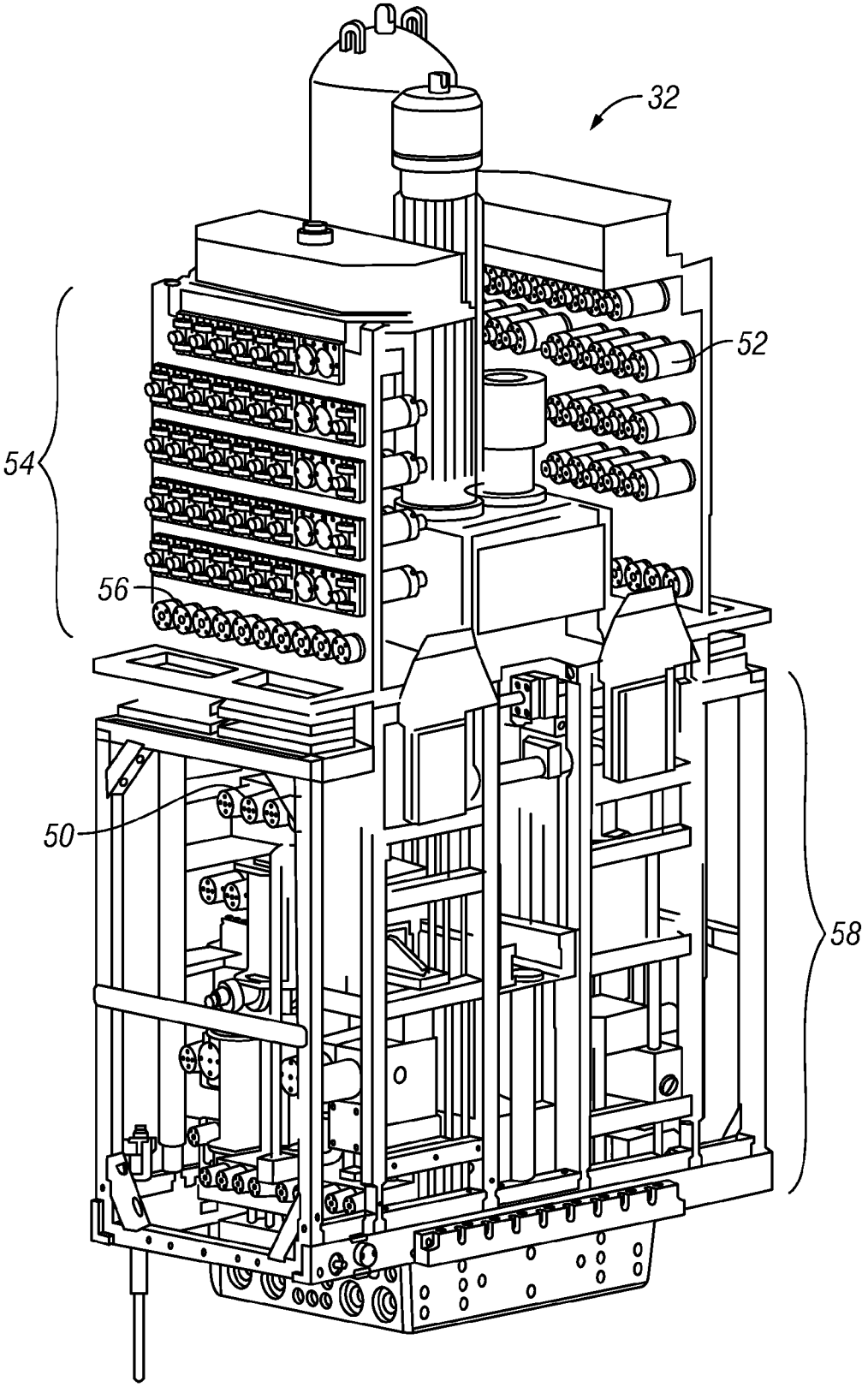
FIG. 2 shows a perspective view of a subsea drilling system in accordance with one or more embodiments of the present disclosure.

Referring now to FIG. 2, a perspective view of a subsea control pod 32 in accordance with one or more embodiments of the present disclosure is shown. The subsea control pod 32 may provide numerous functions to the lower BOP stack 11 and/or the LMRP 16. These functions may be initiated and/or controlled from or via the LMRP 16, such as controlled from the drill ship 20 or the surface through the LMRP 16. The subsea control pod 32 may be fixedly attached to a frame (not shown) of the LMRP 16 and may include one or more control valves 50, such as one or more sub-plate mounted ("SPM") valves that may be hydraulically activated, and one or more solenoid valves 52 that are fluidly connected to the hydraulically activated valves 50. The solenoid valves 52 may be provided in an electronic section 54 of the subsea control pod 32 and may be designed to be actuated by sending an electrical signal from an electronic control board thereto (not shown). Each solenoid valve 52 may be configured to activate a corresponding hydraulically activated valve 50. The subsea control pod 32 may include pressure sensors 56 also mounted in the electronic section 54. The hydraulically activated valves 50 may then be provided in a hydraulic section 58 of the subsea control pod 32.

For subsea blowout preventer installations, electrical cables and/or hydraulic lines may transport control signals from the subsea control pod 32 to the LMRP 16 and lower BOP stack 11 such that specified tasks may be controlled from the surface. Once the control signals are received, subsea control valves 50 and 52 are activated and high-pressure hydraulic lines are directed to perform the specified tasks. For example, when an electronic signal has been received subsea, the signal may activate one or more solenoid valves 52, which may in turn provide pilot opening pressure to activate and open one or more control valves 50. After the control valves 50 open, the hydraulic power fluid will flow through the pipe work and activate the BOP stack 11 to function, as desired. Thus, an electrical or a hydraulic signal may operate a plurality of "low-pressure" valves to actuate larger valves to communicate the high-pressure hydraulic lines with the various operating devices of the wellhead stack.

A bridge between the LMRP 16 and the lower BOP stack 11 may be formed that matches the multiple functions from the LMRP 16 to the lower BOP stack 11, such as to fluidly connect the control valves 50 from the subsea control pod 32 provided on the LMRP 16 to dedicated components on the BOP stack 11 or the LMRP 16. The subsea control pod 32 may be used in addition to choke and kill line connections (not shown) or lines that ensure pressure supply to, for example, the shearing function of the BOPs. Examples of communication lines that may be bridged between the LMRP 16 and the lower BOP stack 11 through feed-thru components may include, but are not limited to, hydraulic choke lines, hydraulic kill lines, hydraulic multiplex control lines, electrical multiplex control lines, electrical power lines, hydraulic power lines, mechanical power lines, mechanical control lines, electrical control lines, and/or sensor lines.

Accordingly, disclosed herein is a surge relief valve, and a fluid system for a subsea drilling system that may include a surge relief valve. The fluid system may include a primary fluid flow path that has an inlet and an outlet, with the inlet connectable to a fluid supply source and the outlet connectable to a component with a function, such as a blowout preventer function, controllable by the fluid supply source. A surge relief valve may be connected within the primary fluid flow path between the inlet and the outlet, and a control valve, such as an SPM valve, may be connected within the primary fluid flow path between the surge relief valve and the outlet. Further, a fluid pulsation dampener, such as an in-line fluid dampener, may be connected within the primary fluid flow path, such as between the inlet and the surge relief valve.

Figure 3A:
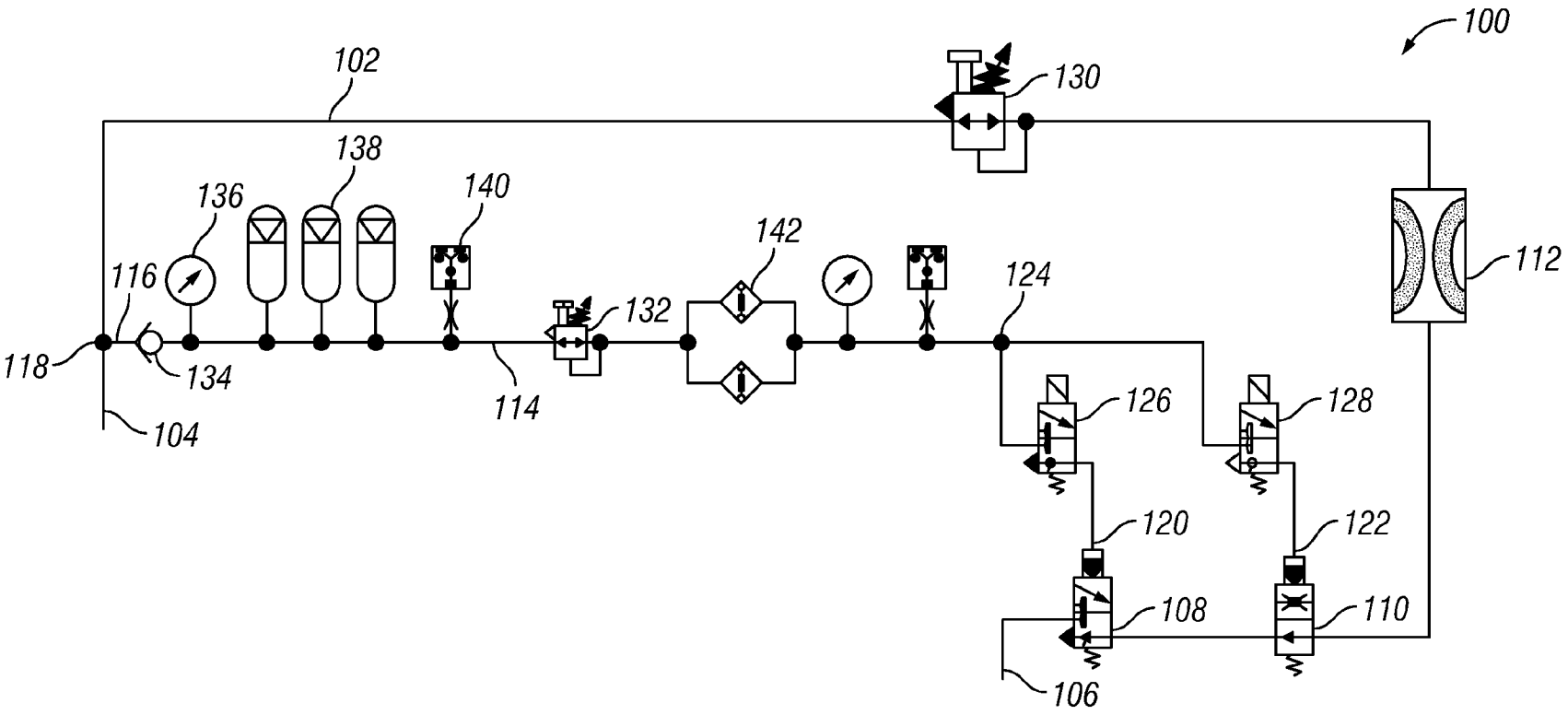
FIG. 3A shows a diagram of a fluid system for a subsea drilling system in accordance with one or more embodiments of the present disclosure.

Referring now to FIG. 3A, a diagram of a fluid system 100 for a subsea control pod in accordance with one or more embodiments of the present disclosure is shown. The fluid system 100 may include a primary fluid flow path 102 with an inlet 104 and an outlet 106. The inlet 104 may be connected to a fluid supply source, such as a source of pressurized hydraulic fluid. The outlet 106 may be connected to a component with a function controllable by the fluid supply source, such as a blowout preventer that has a blowout preventer function that is controllable by the fluid supply source. For example, pressurized hydraulic fluid may be selectively provided to a blowout preventer to selectively open and/or close the rams, the elastomeric packing unit, and/or any other components or functions of a blowout preventer.

The fluid system 100 may include a control valve 108, such as an SPM valve, in which the control valve 108 may be connected within the primary fluid flow path 102 between the inlet 104 and the outlet 106. The control valve 108 may be used to may be used to selectively control fluid flow through the primary fluid flow path 102, thereby selectively providing fluid to the component with the function controllable by the fluid supply source downstream from the outlet 106. As such, in an embodiment in which the fluid system 100 is included within a subsea control pod, the control valve 108 may be an SPM valve to selectively control and provide fluid to a blowout preventer component that controls a blowout preventer function.

The fluid system 100 may include a surge relief valve 110, in which the surge relief valve 110 may be connected within the primary fluid flow path 102 between the inlet 104 and the outlet 106. In particular, the surge relief valve 110 may be connected between the inlet 104 and the control valve 108 such that the surge relief valve 110 is upstream of the control valve 108 within the fluid system 100. The surge relief valve 110 may be used to relieve and/or suppress surges, such as fluid hammer or hydraulic shock, received within the fluid system 100. For example, when a fluid pressure surge or wave is introduced within the primary fluid flow path 102, the surge relief valve 110 may be used to dampen and relieve that pressure surge, thereby preventing the pressure surge from damaging components within the fluid system 100 and/or downstream of the fluid system 100. As such, in one or more embodiments, the surge relief valve 110 may be used to dampen and relieve fluid pressure surges that may damage the control valve 108. A surge relief valve in accordance with embodiments of the present disclosure may also include a fluid surge suppressor, a fluid surge protector, a choke valve, and/or a slow-opening throttling valve.

The fluid system 100 may further include a fluid pulsation dampener 112, in which the fluid pulsation dampener 112 may be connected within the primary fluid flow path 102 between the inlet 104 and the surge relief valve 110. In particular, the fluid pulsation dampener 112 may be upstream of the surge relief valve 110 and the control valve 108 within the fluid system 100. The fluid pulsation dampener 112, which may be an in-line fluid dampener, may be used to reduce hydraulic vibration within the fluid system 100, such as reduce the amplitude of the pressure waves of the fluid. For example, when hydraulic vibration from fluid is introduced within the primary fluid flow path 102, the fluid pulsation dampener 112 may be used to reduce the amplitude of the hydraulic vibration.

Figure 8:
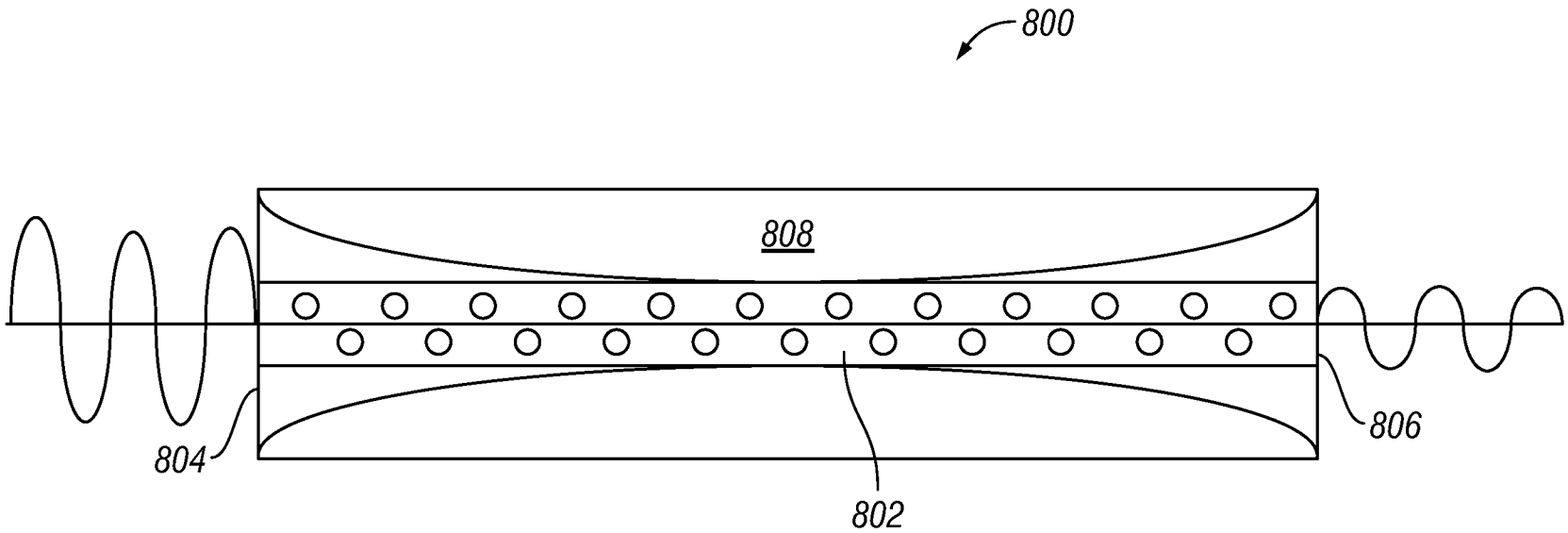
FIG. 8 shows a schematic cross-sectional view of a fluid pulsation dampener in accordance with one or more embodiments of the present disclosure.

For example, with reference to FIG. 8, a fluid pulsation dampener 800 is shown, in which the fluid pulsation dampener 800 is an in-line fluid dampener. As such, the fluid pulsation dampener 800 has a flow path 802 formed therethrough between an inlet 804 and an outlet 806. The fluid pulsation dampener 800 may include a bladder 808, as shown, a piston, or another similar pressurized component, in which the bladder 808 may be pre-charged, such as with nitrogen gas $N_2$. Fluid having hydraulic vibration may have an un-dampened amplitude when entering the fluid pulsation dampener 800 through the inlet 804. As the fluid then flow along the flow path 802, the fluid pulsation dampener 800, such as the bladder 808, may reduce and dampen the amplitude of the hydraulic vibration and fluid, thereby enabling the fluid to have a significantly reduce and dampened amplitude when exiting the fluid pulsation dampener 800 through the outlet 806. As such, the fluid pulsation dampener 800 may provide increased fluid pressure amplitude suppressing capabilities.

In addition to the primary fluid flow path 102, the fluid system 100 may also include a secondary fluid flow path 114. The secondary fluid flow path 114 may be in parallel, at least with a portion of, the primary fluid flow path 102. The secondary fluid flow path 114 may include an inlet 116, in which the inlet 116 may be connected within the fluid system 100 to receive fluid from the fluid supply source. For example, the primary fluid flow path 102 may include a connection 118, in which the inlet 116 of the secondary fluid flow path 114 may be connected to the connection 118 of the primary fluid flow path 102.

The secondary fluid flow path 114 may also include one or more outlets. For example, as shown in FIG. 3A, the secondary fluid flow path 114 may include a first outlet 120 and a second outlet 122, in which the first outlet 120 and the second outlet 122 may be in parallel with each other within the secondary fluid flow path 114. In particular, the secondary fluid flow path 114 may include a connection 124 with the first outlet 120 extending from one side of the connection 124 and the second outlet 122 extending from another side of the connection 124. The first outlet 120 may be connected to the control valve 108, and the second outlet 122 may be connected to the surge relief valve 110.

As such, in accordance with one or more embodiments of the present disclosure, the control valve 108 and/or the surge relief valve 110 may be pilot-operated. For example, by including the secondary fluid flow path 114, one or more pilot valves may be included within the fluid system 100. A first pilot valve 126 may be connected within the secondary fluid flow path 114 between the inlet 116 and the first outlet 120. In particular, the first pilot valve 126 may be connected within the secondary fluid flow path 114 between the connection 124 and the first outlet 120, upstream of the valve 120. A second pilot valve 128 may also be connected within the secondary fluid flow path 114 between the inlet 116 and the second outlet 122. In particular, the second pilot valve 128 may be in parallel with the first pilot valve 126, in which the second pilot valve 128 may be connected within the secondary fluid flow path 114 between the connection 124 and the second outlet 122, upstream of the surge relief valve 110.

Figure 3B:
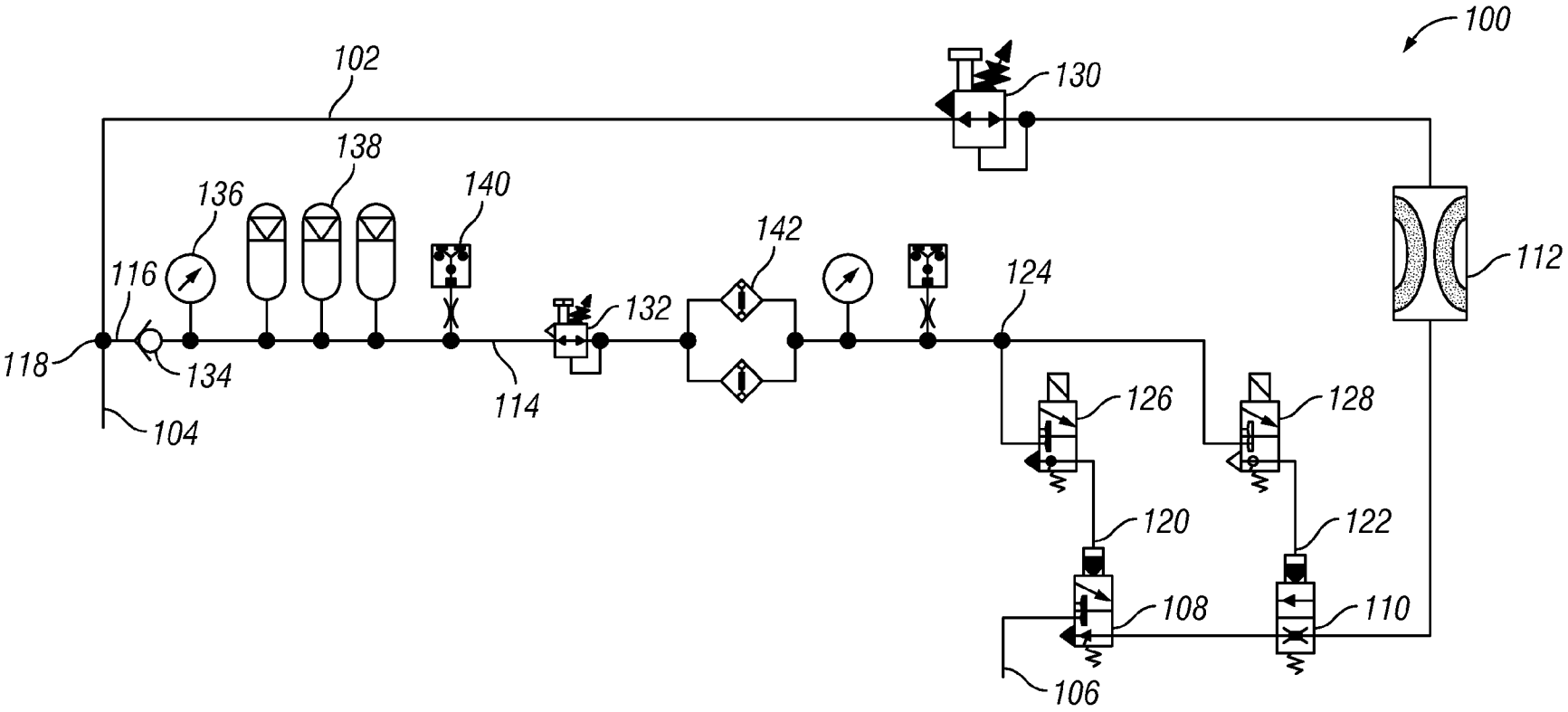
FIG. 3B shows a diagram of a fluid system for a subsea drilling system in accordance with one or more embodiments of the present disclosure.

Accordingly, as the control valve 108 and/or the surge relief valve 110 may be pilot-operated valves, the first pilot valve 126 may be used to control (e.g., open, close, prime, etc.) the control valve 108, and the second pilot valve 128 may be used to control the surge relief valve 110. In one or more embodiments, the control valve 108 may be three way-two position valve, with the control valve 108 normally closed and pilot-operated to open, and/or may also include a spring return. Further, the control valve 108 may be a half-inch valve, a one-inch valve, and/or a one-and-a-half-inch valve. The surge relief valve 110 may be an orificed valve and/or an orificed check valve such that fluid flow may be allowed in one direction (e.g., downstream) and may be restricted and limited in the other direction (e.g., upstream). As such, the surge relief valve 110 may be normally open and pilot-operated through the orifice and/or may also include a spring return. Alternatively, as shown in FIG. 3B, the surge relief valve 110 may be normally restricted through the orifice and pilot-operated to open.

Referring back to FIG. 3A, the first pilot valve 126 and/or the second pilot valve 128 may be solenoid-operated valves. For example, the first pilot valve 126 and/or the second pilot valve 128 may include a solenoid, in which the first pilot valve 126 and/or the second pilot valve 128 may be controlled by an electric current through the solenoid. As shown, the first pilot valve 126 may be three way-two position valve, with the first pilot valve 126 normally closed and solenoid-operated to open, and/or may also include a spring return. Similarly, the second pilot valve 128 may be three way-two position valve, with the second pilot valve 128 normally closed and solenoid-operated to open, and/or may also include a spring return. Furthermore, in one or more embodiments, the first pilot valve 126 and/or the second pilot valve 128 may be a direct drive valve ("DDV").

The fluid system 100 may include one or more pressure regulators. For example, as shown, a first pressure regulator 130 may be connected within the primary fluid flow path 102 between the inlet 104 and the surge relief valve 110 and/or the fluid pulsation dampener 112 (if present). As such, the first pressure regulator 130 may be upstream of the surge relief valve 110 and/or the fluid pulsation dampener 112. Further, a second pressure regulator 132 may be connected within the secondary fluid flow path 114 between the inlet 116 and the first outlet 120 and/or the connection 124 (if present). As such, the second pressure regulator 132 may be upstream of the first pilot valve 126 and/or the second pilot valve 128.

In addition or in alternative to the components discussed in FIG. 3A, the fluid system 100 may include one or more other components without departing from the scope of the present disclosure. For example, a check valve 134 may be included within the fluid system 100, such as within the second fluid flow path 114, between the inlet 116 and the first outlet 120 and/or the connection 124 (if present). As such, the check valve 134 may be upstream of the first pilot valve 126 and/or the second pilot valve 128. A pressure gauge 136 may be included within the fluid system 100, such as within the second fluid flow path 114, between the inlet 116 and the first outlet 120 and/or the connection 124 (if present), in which the pressure gauge 136 may be upstream of the first pilot valve 126 and/or the second pilot valve 128.

One or more accumulators 138 (e.g., gas-charged accumulators) may also be included within the fluid system 100, such as within the second fluid flow path 114, between the inlet 116 and the first outlet 120 and/or the connection 124 (if present), in which the accumulators 138 may be upstream of the first pilot valve 126 and/or the second pilot valve 128. Further, a pressure regulator 140 may be included within the fluid system 100, such as within the second fluid flow path 114, between the inlet 116 and the first outlet 120 and/or the connection 124 (if present), in which the pressure regulator 140 may be upstream of the first pilot valve 126 and/or the second pilot valve 128. Furthermore, one or more filters 142 may be included within the fluid system 100, such as within the second fluid flow path 114, between the inlet 116 and the first outlet 120 and/or the connection 124 (if present), in which the filters 142 may be upstream of the first pilot valve 126 and/or the second pilot valve 128.

In accordance with one or more embodiments of the present disclosure, when in operation, the second pilot valve 128 may be energized, such as through the use of a solenoid, in which the second pilot valve 128 may activate the surge relief valve 110. The first pilot valve 126 may then be energized, such as with a three to four second delay, in which the first pilot valve 126 may activate and open the control valve 108. After both the first pilot valve 126 and the second pilot valve 128 have been energized and opened, the second pilot valve 128 may be de-energized, such as with a two second delay, to de-activate the surge relief valve 110. The first pilot valve 126 may then be de-energized to de-activate and close the control valve 108.

As shown and discussed above, a surge relief valve may be included within a fluid system for a subsea control pod in accordance with one or more embodiments of the present disclosure. As such, as also discussed above, the surge relief valve may be used to reduce, suppress, dampen, and/or relieve surges, such as fluid hammer or hydraulic shock, received by the surge relief valve. Accordingly, a surge relief valve in accordance with the present disclosure may include a housing with an inlet, an outlet, and a seat formed therein adjacent the inlet. A valve body may be positioned within the housing with a flow path formed about the valve body and between the inlet and the outlet within the housing. A poppet may be positioned within the housing that is movable into and out of engagement with the seat. Further, a biasing mechanism may be positioned within the housing to bias the poppet towards the seat of the housing.

Figure 4:
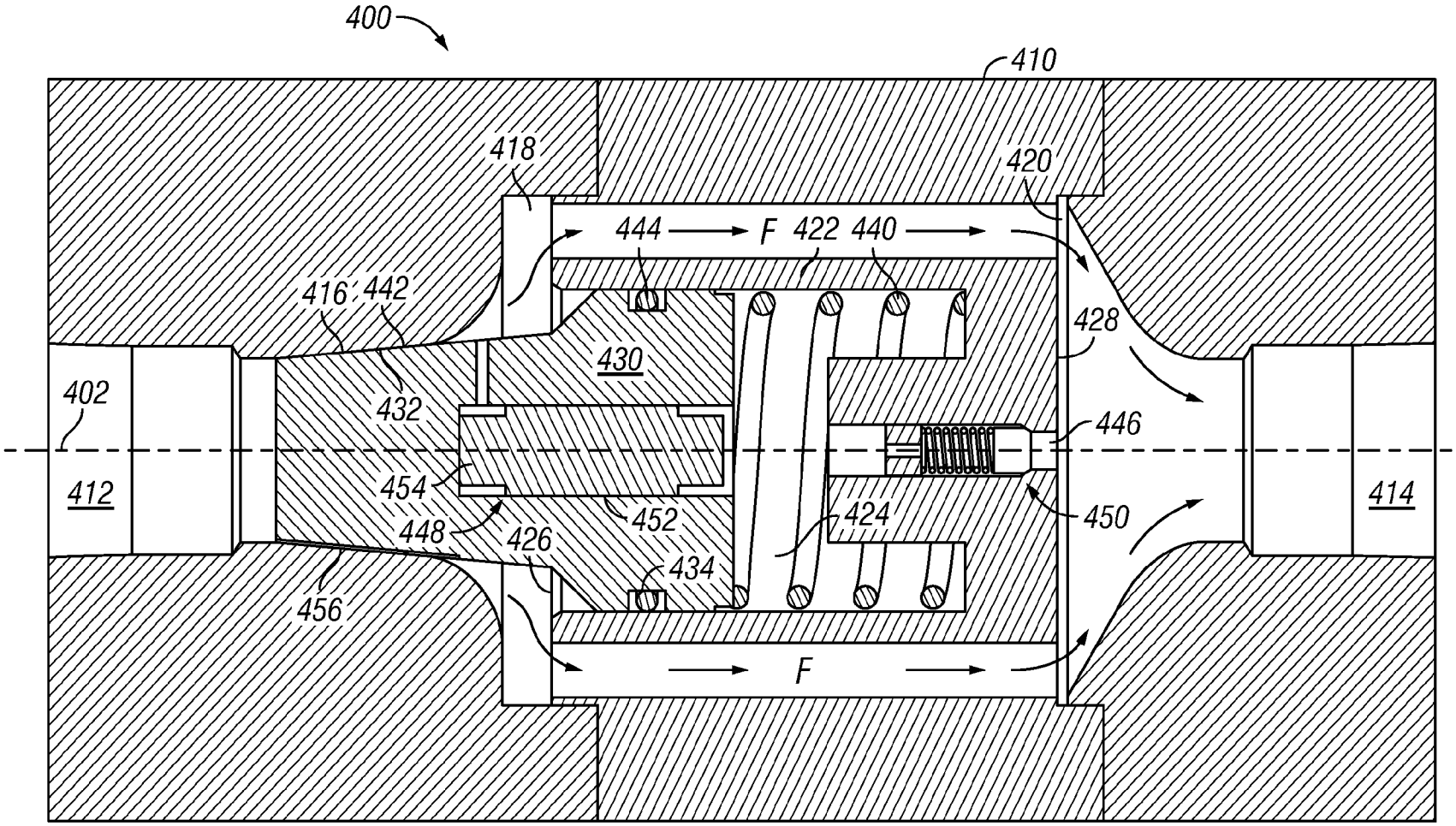
FIG. 4 shows a cross-sectional view of a surge relief valve in accordance with one or more embodiments of the present disclosure.
Figure 5:
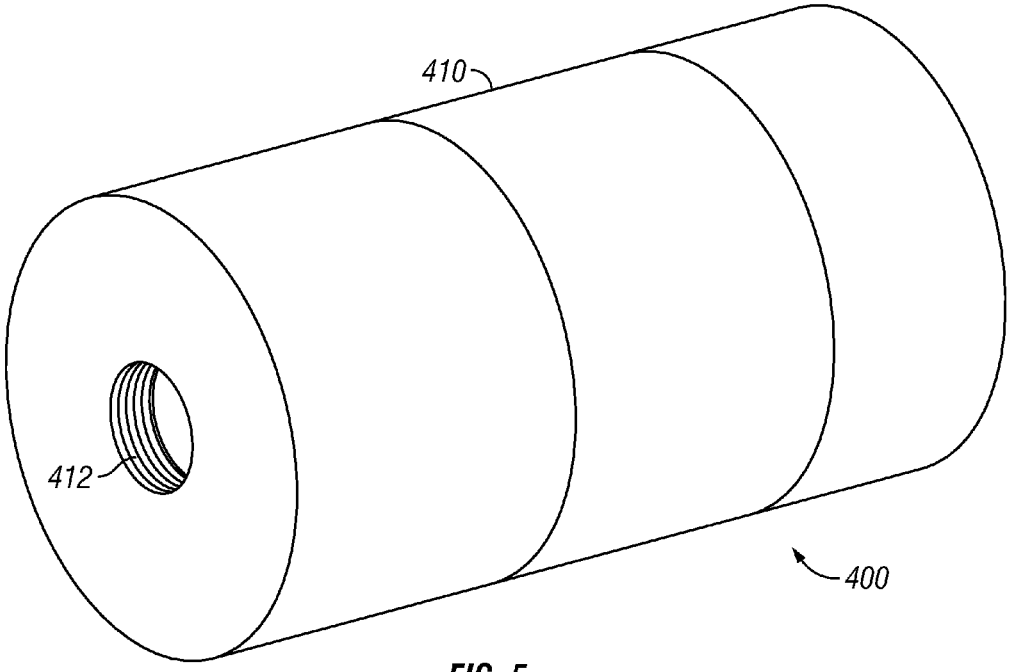
FIG. 5 shows a prospective outer view of a surge relief valve in accordance with one or more embodiments of the present disclosure.
Figure 6:
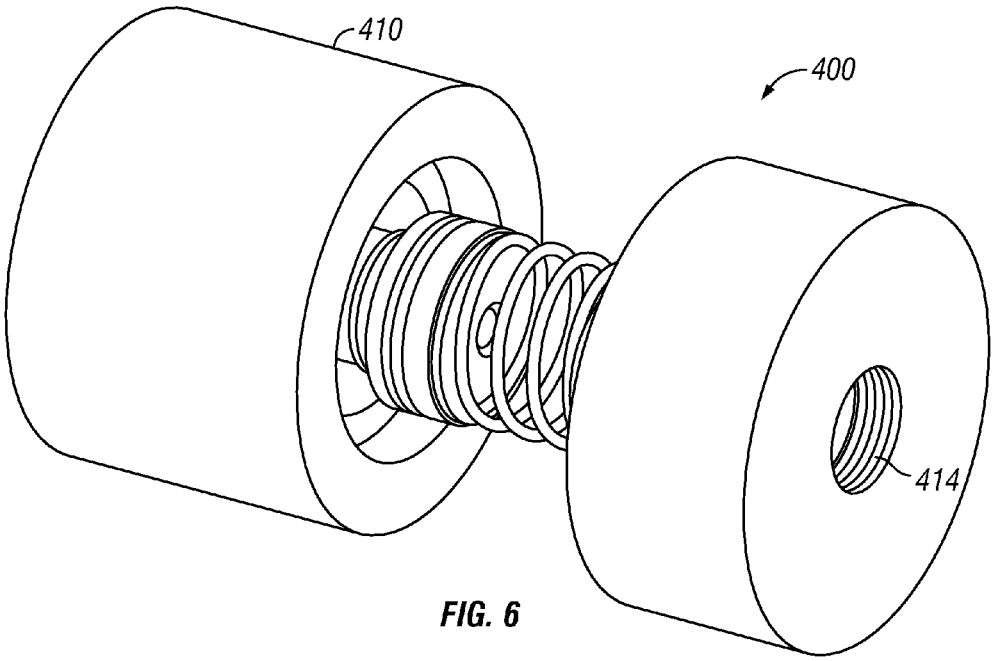
FIG. 6 shows a prospective partially exploded view of a surge relief valve in accordance with one or more embodiments of the present disclosure.

Referring now to FIGS. 4-6, multiple views of a surge relief valve 400 in accordance with one or more embodiments of the present disclosure are shown. Specifically, FIG. 4 provides a cross-sectional view of the surge relief valve 400, FIG. 5 provides a prospective outer view of the surge relief valve 400, and FIG. 6 provides a prospective partially exploded view of the surge relief valve 400.

As shown, the surge relief valve 400 may have an axis 402 formed therethrough and may include a housing 410, such as a cylindrical housing. The housing 410 may include an inlet 412 and an outlet 414. The inlet 412 may be used to receive flow therein, and the outlet 414 may be used to expel fluid therefrom. Further, the inlet 412 and/or the outlet 414 may be used to fluidly connect to a fluid system, as shown and discussed above. As such, the inlet 412 and/or the outlet 414 may be used to sealingly engage other components, such as by having a threaded or sealed connection between the inlet 412 and/or the outlet 414 of the surge relief valve 400 and a pipe, line, fluid flow path, or other component of a fluid system. Further, the housing 410 may be formed as multiple pieces or portions connected to each other, as shown, such as by having the multiple portions of the housing 410 threadedly connected or bolted to each other. Alternatively, in one or more embodiments, the housing 410 may be formed as a single component.

The housing 410 of the surge relief valve 400 may include a seat 416. As shown in FIG. 4, the seat 416 may be formed adjacent the inlet 412 of the housing 410. Further, the housing 410 may include one or more shoulders or abutment surfaces formed therein, such as to facilitate retaining one or more components within the housing 410. As such, and as shown in FIG. 4, the housing 410 may include an inlet side shoulder 418, which may be formed within the housing 410 on the side inlet 412, and/or may include an outlet side shoulder 420, which may be formed within the housing 410 on the side of the outlet 414.

A valve body 422 may be included within the surge relief valve 400, in which the valve body 422 may be positioned within the housing 410. In particular, the valve body 422 may be positioned between and/or adjacent the inlet side shoulder 418 and the outlet side shoulder 420. The valve body 422 may be positioned within the housing 410 such that a flow path F for fluid flowing within and/or through the surge relief valve 400 may be formed about the valve body 422 and between the inlet 412 and the outlet 414 within the housing 410.

In addition to the valve body 422, a poppet 430 and a biasing mechanism 440 may be positioned within the housing 410. The poppet 430 may be movable within the housing 410, in which the poppet 430 may be movable into and out of engagement with the seat 416. The poppet 430 is shown in FIG. 4 as engaged with the seat 416, which may be referred to as a closed position for the poppet 430 within the surge relief valve 400. As such, the poppet 430 may be movable towards and away from the seat 416 of the housing 410 (i.e., movable along the axis 402) such that when the poppet 430 moves away from the seat 416, the poppet 430 may disengage from the seat 416, which may be referred to as an open position for the poppet 430 within the surge relief valve 400. The biasing mechanism 440 may then be positioned within the housing 410 to bias the poppet 430 towards the seat 416. In particular, the biasing mechanism 440 may be positioned between the valve body 422 and the poppet 430 to bias the poppet 430 towards the seat 416 of the housing 410. The biasing mechanism 440 may be a spring, as shown in FIG. 4, and/or any other biasing mechanism known in the art that may bias the poppet 430 towards the seat 416 and away from the valve body 422.

Further, as shown in FIG. 4, the poppet 430 may include a tapered outer surface 432, and the seat 416 may include a tapered inner surface 442, in which the tapered outer surface 432 of the poppet 430 may compliment the tapered inner surface 442 of the seat 416. The tapered outer surface 432 of the poppet 430 may be tapered with respect to the axis 402 and towards the inlet 412 such that the tapered outer surface 432 of the poppet 430 has a larger outer diameter towards the outlet 414 than towards the inlet 412. Similarly, the tapered inner surface 442 of the seat 416 may be tapered with respect to the axis 402 and towards the inlet 412 such that the tapered inner surface 442 of the seat 416 has a larger outer diameter towards the outlet 414 than towards the inlet 412. As such, the tapered outer surface 432 of the poppet 430 may engage with the tapered inner surface 442 of the seat 416 when the poppet 430 is moved towards the seat 416 to engage the seat 416 within the housing 410.

Referring now to FIGS. 4-6, and as discussed above, the poppet 430 may be movable within the housing 410. As such, the poppet 430 may be movable with respect to the valve body 422. In particular, the poppet 430 and the valve body 422 may be movably engaged (e.g., slidingly engaged) with each other such that a cavity 424 may be formed between the valve body 422 and the poppet 430 when the poppet 430 is engaged with the seat 416. The cavity 424 may be largest when the poppet 430 is in the closed position and engaged with the seat 416. As the poppet 430 moves away from the seat 416 and towards the valve body 422 then, the cavity 424 may get smaller, if not fully extinguished altogether depending on the inner profiles of the poppet 430 and the valve body 422.

As shown in FIG. 4, the poppet 430 may be positioned, at least partially, within the valve body 422. For example, the valve body 422 may have an open end 426, in which the poppet 430 may be received within the open end 426 of the valve body 422. However, in other embodiments, the valve body 422 may be positioned, at least partially, within the poppet 430. Further, a seal 444 may be positioned between the valve body 422 and the poppet 430. For example, as shown in FIG. 4, a groove 434 may be formed within the outer surface of the poppet 430, in which the seal 444 may be retained within the groove 434 to seal between the valve body 422 and the poppet 430. However, the present disclosure is not so limited, as other configurations or arrangements may be used to sealingly engage the valve body 422 with the poppet 430 without departing from the scope of the present disclosure.

The cavity 424 formed between the valve body 422 and the poppet 430 may be used to receive fluid therein and expel fluid therefrom. As such, one or more fluid pathways may be incorporated into the surge relief valve 400 such that fluid may be received within and expelled from the cavity 424. In one or more embodiments of the present disclosure, a port 446 and/or a restricted flow path 448 may extend between the cavity 424 and the flow path F formed about the valve body 422 such that the cavity 424 and the flow path F are in selective fluid communication with each other through the port 446 and the restricted flow path 448. The port 446 and/or the restricted flow path 448 may be included and/or formed within the valve body 422 and/or the poppet 430, as shown in FIG. 4. Alternatively, the port 446 and/or the restricted flow path 448 may be formed or included within other elements or components of the surge relief valve 400 to have the cavity 424 and the flow path F about the valve body 422 in selective fluid communication with each other through the port 446 and the restricted flow path 448 without departing from the scope of the present disclosure.

Referring still to FIG. 4, in this embodiment, the port 446 may be formed in the valve body 422, such as formed within an end 428 of the valve body 422 opposite the open end 426. As such, the port 446 may extend from the end 428 of the valve body 422 to the cavity 424. Further, in this embodiment, the restricted flow path 448 may be formed within the poppet 430, such as by having the restricted flow path 448 extend from adjacent tapered outer surface 432 of the poppet 430 to the cavity 424.

As discussed above, the valve body 422 and the poppet 430 may be movable with respect to each other such that the cavity 424 is formed when the poppet 430 is engaged with the seat 416. As such, the cavity 424 may be used to receive fluid therein and expel fluid therefrom. In particular, in the embodiment shown in FIG. 4, when the poppet 430 is moving away from the valve body 422 and towards the seat 416, the cavity 424 may receive fluid therein through the port 446. For example, as shown in FIG. 4, a check valve 450 may be positioned within the port 446, in which the check valve 450 may be used to allow fluid to enter into the cavity 424 through the port 446 and prevent fluid to exit from the cavity 424 through the port 446. As such, when the poppet 430 is moving away from the valve body 422 and towards the seat 416, fluid may be received from the flow path F about the valve body 422, through the port 446 and across the check valve 450, and into the cavity 424.

Further, when the poppet 430 is moving towards the valve body 422 and away from the seat 416, the cavity 424 may expel fluid therefrom through the restricted flow path 448. The restricted flow path 448 may be used to control fluid flow therethrough such that fluid flows through the restricted flow path 448 at a restricted rate, such as an orifice that has fluid flow therethrough affected by viscosity. For example, as shown in FIG. 4, a bore 452 may be formed between the cavity 424 and the flow path F, such as by having the bore 452 formed within the poppet 430. A pressure snubber 454 may then be positioned within the bore 452 such that fluid may flow between the bore 452 and the pressure snubber 454 at a restricted rate.

As discussed above, a surge relief valve in accordance with the present disclosure may be used to reduce, suppress, dampen, and/or relieve surges, such as fluid hammer or hydraulic shock, received by the surge relief valve. Accordingly, with respect to FIGS. 4-6, as fluid, such as a fluid surge, is received within the inlet 412 of the surge relief valve 400, the fluid may exert pressure and force on the poppet 430, thereby forcing the poppet 430 to unseat and disengage from the seat 416 and move away from the seat 416 and towards the valve body 422. As the poppet 430 moves away from the seat 416, the poppet 430 may exert pressure on fluid within the cavity 424. This pressure may expel fluid from the cavity 424 to flow through the restricted flow path 448 at a restricted rate. As such, the valve body 422, the poppet 430, and fluid within the cavity 424 may be used to absorb energy from the fluid surge, thereby reducing, suppressing, dampening, and/or otherwise relieving the fluid surge.

As fluid then continues to flow into the surge relief valve 400, fluid may flow about the valve body 422 along flow path F, and may then exit through the outlet 414. After fluid flow ceases, the biasing mechanism 440 may then bias and urge the poppet 430 away from the valve body 422 and towards the seat 416 such that the poppet 430 seats and engages with the seat 416. As the poppet 430 moves away from the valve body 422 and towards the seat 416, fluid may be received from the flow path F about the valve body 422 and into the cavity 424 through the port 446. As the port 446 includes the check valve 450 therein, the check valve 450 may allow fluid to enter into the cavity 424 through the port 446, but may prevent fluid to exit from the cavity 424 through the port 446. Further, when using a surge relief valve in accordance with the present disclosure, the surge relief may be mounted such that the inlet side of the surge relief valve is oriented upwards. This may enable the surge relief valve to purge lighter fluids, such as gas and air therefrom, that may become trapped within the surge relief valve as liquid passes therethrough.

In accordance with one or more embodiments of the present disclosure, a groove may be formed within the poppet and/or the seat of the housing, such as within the tapered outer surface of the poppet and/or the tapered inner surface of the seat. For example, with reference to FIG. 4, a groove 456 may be formed within the tapered outer surface 432 of the poppet 430. As such, fluid may be able to pass (e.g., leak) within the groove 456 between the seat 416 and the poppet 430 when the poppet 430 is seated and engaged with the seat 416.

Figure 7:
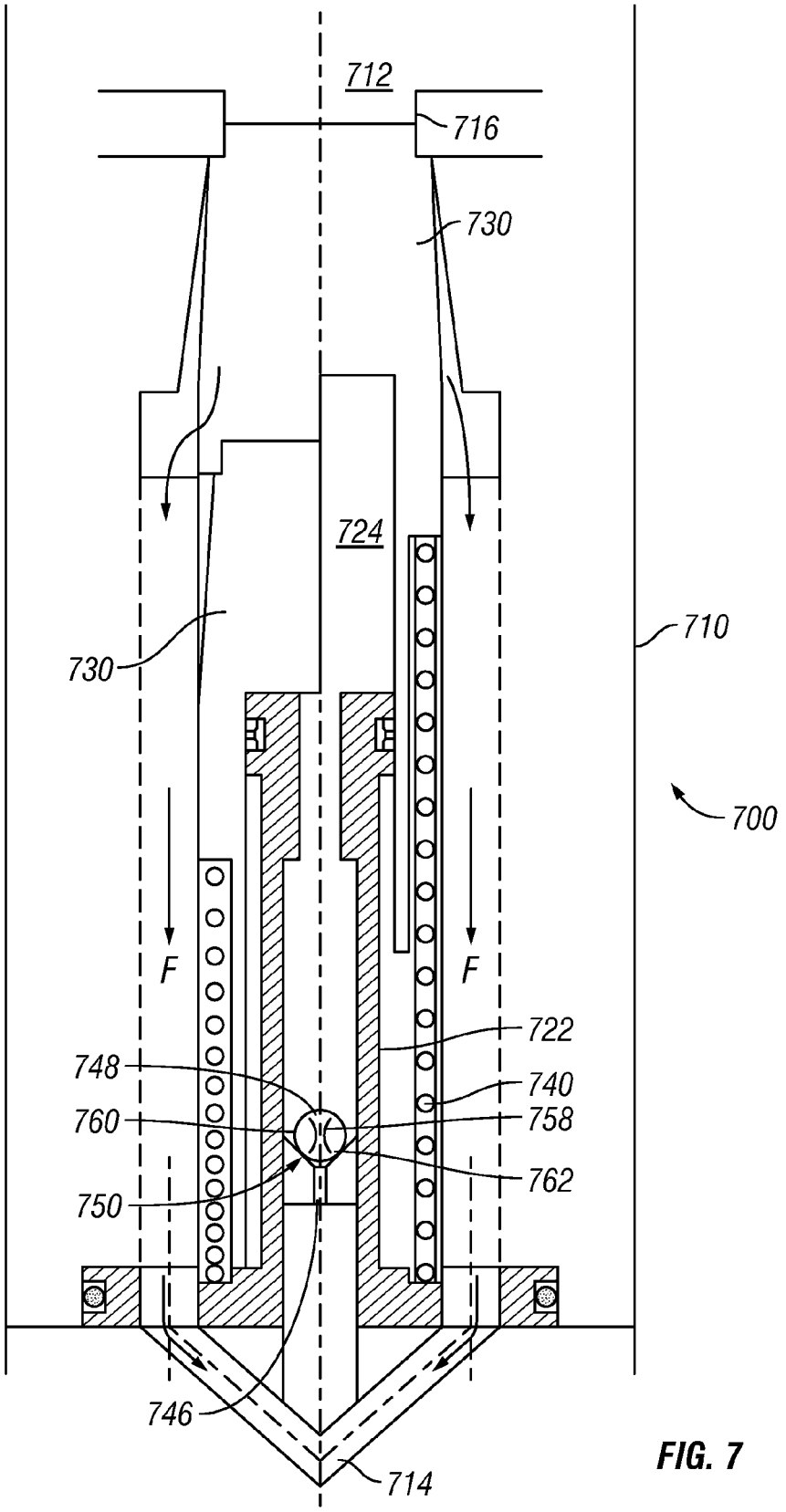
FIG. 7 shows a cross-sectional view of a surge relief valve in accordance with one or more embodiments of the present disclosure.

Referring now to FIG. 7, a cross-sectional view of a surge relief valve 700 in accordance with one or more embodiments of the present disclosure is shown. Similar to the surge relief valve 700 shown in FIGS. 4-6, the surge relief valve 700 may include a housing 710 with an inlet 712, an outlet 714, and a seat 716, a valve body 722, and a biasing mechanism 740. Further, the surge relief valve includes a poppet 730, in which the poppet 730 is movable into and out of engagement with the seat 716. As such, one side (i.e., the right side) in FIG. 7 shows the surge relief valve 700 in the closed position with the poppet 730 seated and engaged with the seat 716, and the other side (i.e., the left side) in FIG. 7 shows the surge relief valve 700 in the open position with the poppet 730 unseated and disengaged from the seat 716.

As discussed above, the valve body 722 and the poppet 730 may be movable with respect to each other such that a cavity 724 is formed therebetween when the poppet 730 is engaged with the seat 716. As such, in FIG. 7, the valve body 722 may be positioned, at least partially, within the poppet 730. Further, the biasing mechanism 740 may be positioned between the valve body 722 and the poppet 730, such as by having the biasing mechanism 740 positioned about the poppet 730 and the valve body 722 to bias the poppet 730 away from the valve body 722 and towards the seat 716.

Further, as also similar to the surge relief valve 400 shown in FIG. 4, the surge relief valve 700 may include a port 746 and a restricted flow path 748. The port 746 and/or the restricted flow path 748 may extend between the cavity 724 and the flow path F formed about the valve body 722 and the poppet 730 such that the cavity 724 and the flow path F are in selective fluid communication with each other through the port 746 and the restricted flow path 748. In this embodiment, the port 746 may be formed in the valve body 722, such as formed within an end 728 of the valve body 722. As such, a check valve 750 may be positioned within the port 746, in which the check valve 750 may be used to allow fluid to enter into the cavity 724 through the port 746 and prevent fluid to exit from the cavity 724 through the port 746. As such, when the poppet 730 is moving away from the valve body 722 and towards the seat 716, fluid may be received from the flow path F, through the port 746 and across the check valve 750, and into the cavity 724.

Further, when the poppet 730 is moving towards the valve body 722 and away from the seat 716, the cavity 724 may expel fluid therefrom through the restricted flow path 748. The restricted flow path 748 may be used to control fluid flow therethrough such that fluid flows through the restricted flow path 748 at a restricted rate. As such, in FIG. 7, the restricted flow path 748 may include an orifice 758 formed within and through the check valve 750. For example, the check valve 750 may include an engagement member 760 movable into and out of engagement with a seat 762 to selectively allow fluid flow through the port 746. The engagement member 760 may have the orifice 758 formed therethrough such that fluid may flow through the orifice 758 at a restricted rate.

A valve in accordance with one or more embodiments of the present disclosure may be used to reduce, suppress, dampen, and/or relieve surges, such as fluid hammer or hydraulic shock, received by the valve. For example, a fluid surge may be three to four times the working pressure of a valve and may typically open the valve abruptly, such as within milliseconds. This may cause damage to the valve and/or components included within a fluid system with the valve, including the lines and hoses connecting the fluid system and pistons and seals used within the fluid system. However, a surge relief valve in accordance with the present disclosure may be able to reduce the affect from a fluid surge, which may be designed to take approximately one second or several seconds to move from the closed position to the fully open position. The surge relief valve may or may not require any external signal and/or operations to function, and the surge relief valve may automatically move from the open position to the closed position when fluid flow ceases. Further, a surge relief valve in accordance with the present disclosure may be fail safe open such that, if a component of the surge relief valve may fail, the surge relief valve may still allow fluid flow therethrough.

Although the present invention has been described with respect to specific details, it is not intended that such details should be regarded as limitations on the scope of the invention, except to the extent that they are included in the accompanying claims.

What is claimed is:

1. A subsea drilling system, comprising:

a blowout preventer stack;

a blowout preventer subsea control pod configured to control an operation of the blowout preventer stack and comprising a fluid system, the fluid system comprising:

a primary fluid flow path including an inlet and an outlet, the inlet connectable to a fluid supply source, the outlet connectable to a component of the blowout preventer stack controllable by the fluid supply source;

a surge relief valve connected within the primary fluid flow path between the inlet and the outlet; and a control valve connected within the primary fluid flow path between the surge relief valve and the outlet such that hydraulic pressure surges received within the primary fluid flow path are dampened, at least partially, by the surge relief valve before received by the control valve.

2. The subsea drilling system of claim 1, wherein the blowout preventer stack is hydraulically coupled to the fluid system of the blowout preventer subsea control pod.

3. The subsea drilling system of claim 2, further comprising a lower marine riser package that includes the blowout preventer subsea control pod.

4. The subsea drilling system of claim 3, further comprising a riser with the lower marine riser package coupled to the riser.

5. The subsea drilling system of claim 2, wherein the control valve comprises a sub-plate mounted valve and a pilot-operated valve.

6. A fluid system for a subsea drilling system including a component controllable by the fluid system, comprising:

a primary fluid flow path including an inlet and an outlet, the inlet connectable to a fluid supply source, the outlet connectable to the component;

a surge relief valve connected within the primary fluid flow path between the inlet and the outlet, the surge relief valve movable between at least two positions and biased towards one of the positions; and a control valve connected within the primary fluid flow path between the surge relief valve and the outlet such that hydraulic pressure surges received within the primary fluid flow path are dampened, at least partially, by the surge relief valve before received by the control valve.

7. The fluid system of claim 6, further comprising a fluid pulsation dampener connected within the primary fluid flow path between the inlet and the surge relief valve such that fluid surges received within the primary fluid flow path are dampened, at least partially, by the fluid pulsation dampener before received by the surge relief valve.

8. The fluid system of claim 6, wherein the control valve comprises a sub-plate mounted valve.

9. The fluid system of claim 6, wherein the control valve comprises a pilot-operated valve, and wherein the system further comprising:

a secondary fluid flow path including an inlet and an outlet, the inlet connectable to the primary fluid flow path to receive fluid from the fluid supply source, the outlet connectable to the control valve; and a pilot valve connected within the second fluid flow path between the inlet and the outlet.

10. The fluid system of claim 9, wherein the surge relief valve comprises a pilot-operated valve, wherein the secondary fluid flow path includes a second outlet, wherein the second outlet is connectable to the surge relief valve, and wherein a second pilot valve is connected within the second fluid flow path between the inlet and the second outlet.

11. The fluid system of claim 10, wherein at least one of the first pilot valve and the second pilot valve comprises a solenoid-operated direct drive valve.

12. The fluid system of claim 6, wherein the component comprises a blowout preventer controllable by the fluid supply source.

13. The fluid system of claim 6, further comprising a pressure regulator connected within the primary fluid flow path between the inlet and the surge relief valve.

14. A subsea drilling system including:

a subsea component controllable by fluid actuation; and a fluid system for fluidly controlling the component, the fluid system comprising:

a primary fluid flow path connectable between a fluid supply source and the subsea component;

a fluid pulsation dampener configured to dampen an amplitude of a fluid pulse and connected within the primary fluid flow path;

a surge relief valve connected within the primary fluid flow path downstream of the fluid pulsation dampener such that fluid surges received within the primary fluid flow path are dampened, at least partially, by the fluid pulsation dampener before received by the surge relief valve; and a control valve connected within the primary fluid flow path downstream of the surge relief valve such that hydraulic pressure surges received within the primary fluid flow path are dampened, at least partially, by the surge relief valve before received by the control valve.

15. The subsea drilling system of claim 14, wherein the control valve comprises a sub-plate mounted valve.

16. The subsea drilling system of claim 15, wherein the control valve comprises a pilot-operated valve, the fluid system further comprising:

a secondary fluid flow path connectable in parallel to the primary fluid flow path to receive fluid from the fluid supply source; and a pilot valve connected within the second fluid flow path upstream of the control valve.

17. The subsea drilling system of claim 16, wherein the surge relief valve comprises a pilot-operated valve, the fluid system further comprising a second pilot valve connected within the second fluid flow path in parallel with the first pilot valve and upstream of the surge relief valve.

18. The subsea drilling system of claim 16, further comprising at least one of:

a check valve connected within the second fluid flow path upstream of the pilot valve;

a pressure gauge connected within the second fluid flow path upstream of the pilot valve;

an accumulator connected within the second fluid flow path upstream of the pilot valve;

a pressure regulator connected within the second fluid flow path upstream of the pilot valve; and a filter connected within the second fluid flow path upstream of the pilot valve.

19. The subsea drilling system of claim 14, wherein the fluid pulsation dampener comprises a pre-charged in-line fluid dampener.

* * * * *